US005529431A

United States Patent [19]

Walsh

[11] Patent Number: 5,529,431

[45] Date of Patent: Jun. 25, 1996

[54] TEMPORARY MANHOLE COVER AND METHOD

[75] Inventor: Thomas V. Walsh, 344 Knollwood La., Seaford, N.Y. 11783

[73] Assignees: Alfred T. Francis, Medford, N.J.; Thomas V. Walsh, Seaford, N.Y.

[21] Appl. No.: 393,840

[22] Filed: Feb. 24, 1995

[51] Int. Cl.[6] ..... E02D 29/14

[52] U.S. Cl. ..... 404/25; 210/164; 52/20

[58] Field of Search ..... 404/25, 26; 210/163, 210/164, 166; 52/19–20

[56] References Cited

U.S. PATENT DOCUMENTS

| | | | |
|---|---|---|---|
| 3,920,347 | 11/1975 | Sauriul et al. | 404/25 |
| 4,136,010 | 1/1979 | Pillie' et al. | 210/164 |
| 4,345,998 | 8/1982 | Graffis et al. | 210/164 |
| 4,512,492 | 4/1985 | Graybeal | 220/204 |
| 4,662,777 | 5/1987 | Newton | 404/25 |
| 4,910,811 | 3/1990 | Izzi, Sr. | 210/163 X |
| 4,974,992 | 12/1990 | Harter | 404/25 |
| 5,066,165 | 11/1991 | Wofford et al. | 405/119 |
| 5,123,776 | 6/1992 | Lang et al. | 404/25 |
| 5,130,016 | 7/1992 | Gavin | 210/164 |
| 5,201,151 | 4/1993 | LeBlanc et al. | 52/20 |
| 5,308,118 | 5/1994 | Shaftner | 404/25 |
| 5,312,202 | 5/1994 | Newton | 404/25 |
| 5,361,799 | 11/1994 | Chilton et al. | 137/363 |
| 5,378,078 | 1/1995 | Lewis et al. | 404/25 |

FOREIGN PATENT DOCUMENTS

| | | | |
|---|---|---|---|
| 2456169 | 5/1979 | France . | |
| 131718 | 10/1981 | Japan | 52/20 |
| 0058718 | 3/1989 | Japan | 52/20 |
| 2079355 | 1/1982 | United Kingdom | 52/20 |

*Primary Examiner*—David J. Bagnell
*Assistant Examiner*—James A. Lisehora
*Attorney, Agent, or Firm*—Thomas A. Lennox

[57] ABSTRACT

A temporary manhole cover constructed of glass fiber reinforced resin grate fits into the standard manhole opening is strong enough to support a motor vehicle and light enough to be lifted out from below or above and also includes a cut out to the edge for pipes, tubing, and wires to be trained through the opening down the manhole.

15 Claims, 2 Drawing Sheets

TEMPORARY MANHOLE COVER AND METHOD

BACKGROUND OF THE INVENTION

This invention involves a temporary manhole cover and method of using the cover to protect the manhole entrance as required.

The standard manhole is about two feet in diameter and provides access to underground systems such as sanitary sewer systems and utility lines. In essentially all of these systems, water and weather intrusion into the underground system is to be avoided. The standard manhole cover is a circular cast iron solid disk over one inch thick and designed to be removed only by authorized personnel using tools designed to provided sufficient leverage from above.

Once the cast iron cover, weighing almost 175 pounds, has been lifted and slid off to a side of the manhole, a work person can climb down the manhole. Because of safety requirements, it is necessary to provide a fence around the open hole and appropriate flashing lights and the like to prevent persons from falling into the hole or driving a car over and dropping into the opening. It is further necessary to station a second person above the hole, again for safety purposes. Despite these precautions, the open hole still presents a substantial safety hazard. Not only do unauthorized persons ignore or avoid the barrier, but cars sometimes hit the barrier and end up with a wheel wedged into the manhole. Further, the open hole presents substantial risk to the person working below due to falling objects that inadvertently fall into the manhole. In cases of severe emergency or when multiple manholes must be open at the same time, there may be insufficient personnel. A person working alone at a manhole or when a number of persons are needed down the manhole, the present system is insufficient.

It is important to distinguish between manhole covers and drain grates. Cast iron grates are interfitting into a hole which routinely opens to storm drainage systems below ground. The purpose for these grates is to allow water to flow into the system while preventing intrusion of large foreign objects from above. These systems, by their very nature, are essentially never closed. Grates or catch basin covers are designed and constructed so that it is essentially impossible to lift them out without a leveraging tool. A grate is described in U.S. Pat. No. 4,345,998 to Graffis, et al, the grate being constructed of polyethylene plastic or other "structural plastic materials". A catch basin interceptor covered by a support grill is disclosed in U.S. Pat. No. 4,136,010 to Pilie', et al. A modular trench drain system covered by a linear grate panel is described in U.S. Pat. No. 5,066,165 to Wofford, et al. A rectangular drain grate constructed of glass filled polypropylene is disclosed in U.S. Pat. No. 5,130,016 to Gavin. A solid manhole cover constructed of a polyethylene polymer skin filled with cured cement is disclosed in U.S. Pat. No. 5,123,776 to Lang, et al. A rectangular grate is disclosed in French Patent No. 79 12029, Publication No. 2,456,169 to Morel. With only the abstract available, the composition of the grate is cross-hatched for plastic. A manhole closure in the form of a barrier pan constructed of any suitable impervious, non-corrosive material such as plastic, fiberglass or stainless steel is disclosed in U.S. Pat. No. 4,512,492 to Graybeal. The prior closure is impervious except for a two-way gas pressure release value. A water sealed system of a manhole rim and cover assembly is a described in U.S. Pat. No. 5,201,151 to LeBlanc, et al. A solid access cover assembly constructed of composite plastic material and steel is described in U.S. Pat. No. 5,312,202 to Newton. A ramp with a center hole for a temporarily elevated utility access hole constructed of an elastomeric material is disclosed in U.S. Pat. No. 5,308,188 to Shaftner.

None of these devices and methods of use satisfy the above needs nor attain the objects described herein below.

SUMMARY OF INVENTION

During sanitary sewer cleaning, an employee must be stationed above the open manhole. The new O.S.H.A. Laws state that the employee must be protected from accidental entry. The present cover and method provides protection that one person can install and remove. Even with the temporary cover in place, all aspects of the cleaning operation can be observed.

It is an object of the present invention to provide a temporary manhole cover which is essentially not an air or sound barrier while providing sufficient strength to support a person or a motor vehicle.

It is a further object of the present invention to provide a temporary manhole cover which can be easily lifted for insertion into the hole and be lifted upwardly by a person from below.

It is an additional object of the protection sought herein to provide a cover that when laid in place covering the hole is flush with the roadway surface.

It is a further object of the protection sought herein to provide manhole cover which, while providing full air and sound contact between persons below and above, acts as a shield and essentially prevents any tools or other large objects from accidentally falling down the open manhole and hitting the worker.

It is a further object of the protection sought to provide a temporary manhole cover with an a opening that supports and allows large tubing, such as air blower tubing or pump conduits, to be inserted down the manhole while still providing full protection from above for the persons below.

It is a particular object of the protection sought to provide an open grate with an opening sufficient to receive standard air flow tubing while still allowing space around that opening for electric cords and the like to be fed down to the worker's below.

It is an object of the present invention to provide a temporary manhole cover through which persons working below, during cleaning operations, can be observed by persons above for safety requirements.

It is a further object of the present invention to provide a temporary manhole cover that is light enough in weight that one person can remove it without tools, handle it and easily store it on crew trucks.

It is a particular object of the protection to be sought to provide an answer to the need to vent multiple manholes due to a combustible gas problem. The cover of the present invention, which preferably spark proof, can be used without a person standing by the open hole for safety. In the past, if a manhole had to be left open and unmanned for whatever reason, fencing and barricading had to be installed at considerable expense with limited safety protection. With the present invention, utility companies, fire and police departments, hazardous material units, are able to more easily maintain multiple open manholes.

Another object of the protection to be sought is when a by-pass pumping operation is needed due to sewer line blockage. A temporary cover of the present invention with a four to eight inch hole can be installed. The pump post can be inserted into the hole with the rest of the opening remaining secure. Electric utility companies can run cable through the hole or through edge openings when running temporary power to various locations. The cover may be removed without involving the tubing or wiring.

It is a object of the present invention to provide an emergency exit from the system below ground level. If an emergency exit must be made from the manhole, the temporary cover of the present invention can be quickly removed by one person with no tools and the worker extracted.

An aspect of the invention is a method of protecting a manhole opening through a ground surface, the opening covered by a permanent cover that interfits into the opening and rests on a ledge extending inwardly from an outer edge of the opening. The method includes removing the permanent cover from the manhole opening and setting it to a side. The method further includes providing a temporary manhole cover that includes an integral body that includes a circular disc shape of a size to interfit into the opening, an outer circular edge having a thickness,,and a multiplicity of openings through a thickness of the disc shape spaced apart across the entire shape. The thickness of outer circular edge is sufficient to position a top surface of the body proximate the ground surface, and the body is of a composition of a weight to allow it to be lifted upwardly by a person in the manhole below the temporary manhole cover, and of a strength to support a motor vehicle driving on the top surface of the temporary manhole cover. The method also includes descending into the manhole, and placing the temporary manhole cover into the manhole resting outer circular edge of the body on the ledge extending inwardly from the outer edge of the manhole opening.

It is preferred that the providing of the temporary manhole cover further include an outer circular frame integral with the body, the frame being of a size and shape to interfit into the opening and rest on the ledge. It is further preferred that the providing of the temporary manhole cover further include providing that the body be a composition of a composite material. It is more preferred that the composite material be glass fiber reinforced polymeric plastic and most preferred that the polymeric plastic be cross linked. It is further preferred that the providing of the temporary manhole cover further include providing lifting means to allow the temporary manhole cover interfitted into the manhole opening to be lifted upwardly by a single person standing above the manhole opening. It is more preferred that the lifting means include a rope fed through an opening through the body. It is further preferred that the providing of the temporary manhole cover further include providing a second single opening through the disc shape of the temporary manhole cover, the second single opening having a width in a range of about four inches to about eight inches. It is further preferred that the edges of the second opening open into the openings of the disc shape. It is further preferred that the second opening opens through the outer circular edge of the cover.

Another aspect of the invention is a manhole cover device for temporarily covering a manhole opening through a road surface, the opening being normally covered by a permanent cover that interfits into the opening and rests on a ledge extending inwardly from an outer edge of the opening, wherein the permanent cover has been temporarily removed. The device includes an integral unit that includes a circular disc shape of a size to interfit into the opening, an outer circular edge having a thickness, a multiplicity of openings through a thickness of the disc shape spaced apart across the entire shape, and a second single opening through the thickness of the disc shape, the second single opening having a width of at least about four inches and opens through the outer circular edge of the disc. The thickness of outer circular edge is sufficient to position a top surface of the disc proximate the ground surface, and the integral unit is of a composition of a weight to allow it to be lifted upwardly by a person in the manhole below the temporary manhole cover, and of a strength to support a motor vehicle driving on the top surface of the temporary manhole cover.

It is preferred that the device be as described herein above as provided in the method.

DESCRIPTION OF PREFERRED EMBODIMENTS

Figure 1:
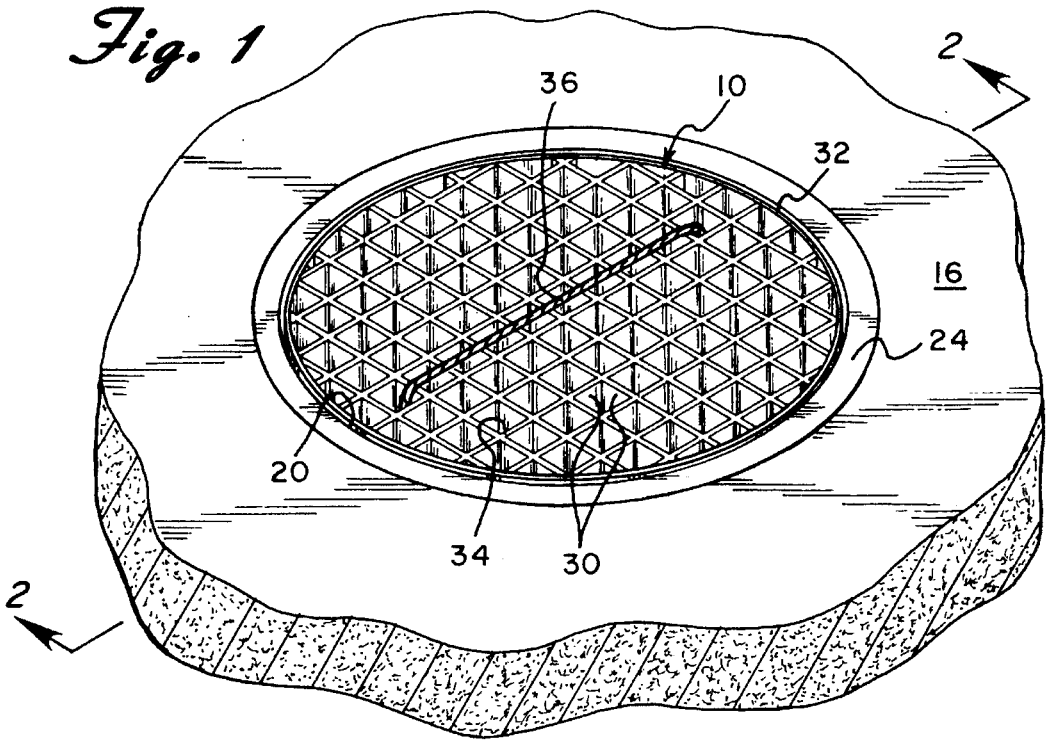
FIG. 1 is a perspective view of a temporary manhole cover of the present invention in place covering a manhole through a roadway surface.
Figure 2:
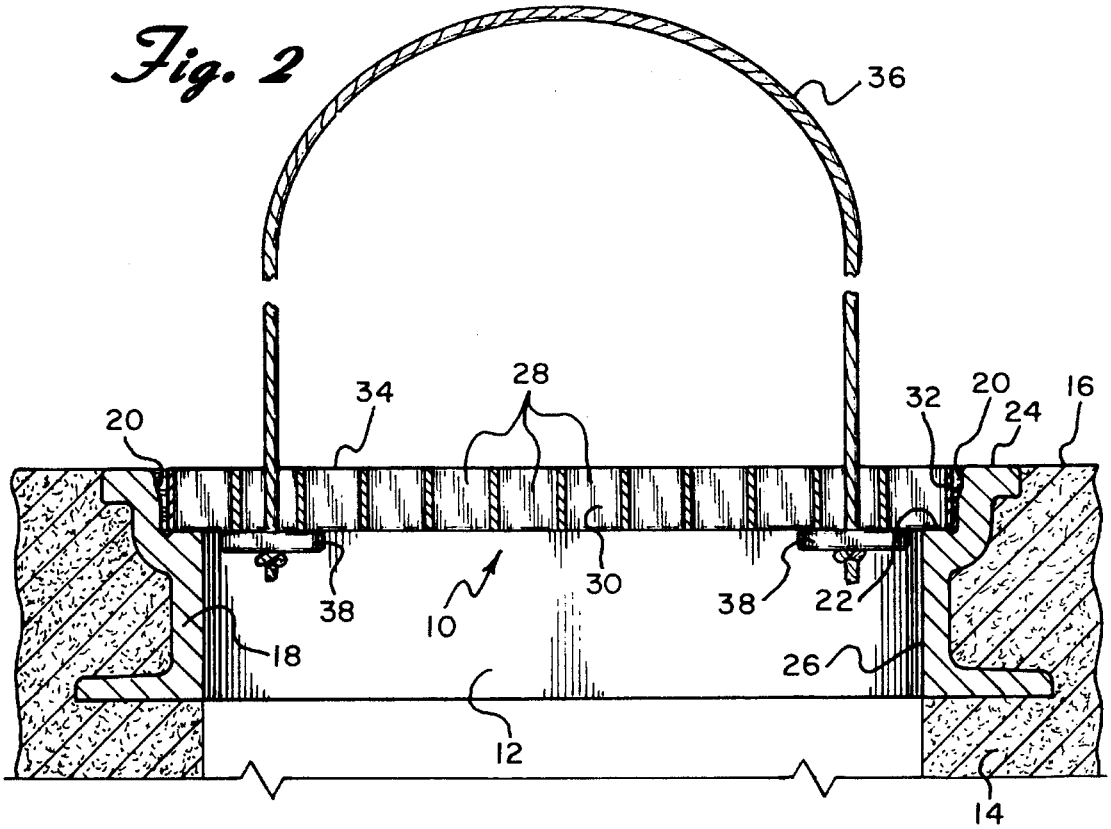
FIG. 2 is a cross sectional view taken along lines 2—2 of FIG. 1.
Figure 3:
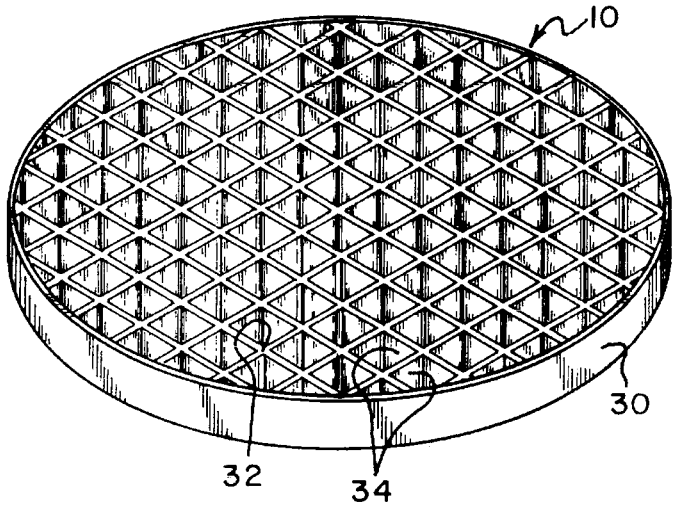
FIG. 3 is a perspective view of the temporary manhole cover illustrated in FIG. 1.

Temporary manhole cover device 10 is illustrated in FIGS. 1 through 3. As shown in FIG. 2, manhole 12 opens through ground 14 supporting roadway surface 16.

The international standards for manhole cover dimensions and the manhole frame is covered in Standard I.S.O. 9000-2. Standard cast iron frame 18 is imbedded in ground 14. Cylindrical frame 18 is about thirty inches in diameter at the lower radial flange and is about seven inches deep from the roadway surface to the bottom of the frame. Inside diameter 20 of the upper lip is about twenty-five inches in diameter. The standard cast iron manhole cover is 24 and 7/16 inches in diameter. Circular inside ledge is spaced two inches below upper rim surface 24 which is exposed at roadway surface 16. The standard manhole cover rests on ledge 22 which is about one inch wide. The inside surface of the cylinder of frame 18 is about 22 inches in diameter, sufficient for persons to easily enter and leave the opening. Device 10 is in integral molding of glass fiber reinforced unsaturated polyester resin. The glass fiber reinforcement is unidirectional fiber wound around square openings 28 which are about one and three-quarter inch square. Vertical walls 30 are slightly over one quarter inch thick and two inches deep. The grate portion of the body is bounded in ¼ inch thick, two inches high cylindrical band 32 which is integrally molded with the grate. This two inch thick dimension places the upper surface 34 of device 10 common with road surface 16. Frame 32 is twenty-five inches in diameter providing secure contact with ledge 22. This structure easily supports a heavy truck driving over or even parking on top of the structure. Rope 36 is threaded through a couple of openings 28 with wooden stops 38 tied underneath to allow the 10 pound device to be easily lifted upwardly by one person. Further, a person working below who wishes to exit the manhole, may easily lift the device upwardly and set it aside from below.

Other suitable materials for construction of the integral molding is glass fiber reinforced epoxy resin, polypropylene polymer, Delrin®, nylon, and like structural materials, including aluminum or other light metals. Other composite materials with other fibrous reinforcements such as graphite, boron are satisfactory. An alternative construction of the integral molding of the body of device 10 is to adhere with epoxy resin a one-eighth inch thick polyethylene band around the grid. While this reduces the strength somewhat, the grid still has sufficient strength for safety purposes. Construction of glass fiber reinforced grates are provided under the trademark CORVEX™ by Fibergrate Company of Dallas, Tex. That grate may be cut to shape to provide a satisfactory unit.

The Department of Labor, Occupational Safety and Health Administration (O.S.H.A), 29 C. F. R. Parts 1910, permit—Required Confined Spaces for General Industry states the following: GENERAL REQUIREMENTS (PARAGRAPH) (c) (5) (ii) (B), When entrance covers are removed, the opening shall be promptly guarded by a railing, temporary cover, or other temporary barrier that will prevent an accidental fall through the opening and will protect each employee working in the space from foreign objects entering the space. PERMIT REQUIRED CONFINED SPACE PROGRAM (d) The employer shall: (1) Implement the measures necessary to prevent unauthorized entry (3) (ii) Isolating the permit space (iii) Purging, inserting, flushing, or ventilating the permit space as necessary to eliminate or control atmospheric hazards (iv) Providing pedestrian, vehicle, or other barriers as necessary to protect entrants from external hazards (4) (ii) Ventilating equipment needed to obtain acceptable entry conditions. The temporary cover of the present invention addresses all of these requirements and concerns.

Figure 4:
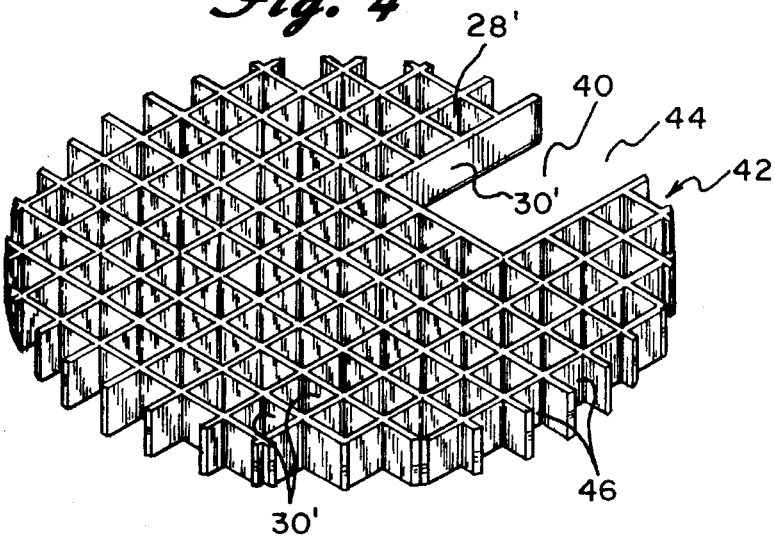
FIG. 4 is a perspective view of a second embodiment the invention.

Cover 42 is illustrated in FIG. 4 which is similar in construction to device 10 except that opening 40 has been cut through the edge of the grate to allow four to six inch tubing to be inserted attached to an air blower or like needs. Since opening 40 opens to edge 44 of the grate cover 42 may be removed and reinstalled to close the opening without disturbing tubing or piping leading down into the manhole. Opening 40 is about a 5½ inch wide Walls 30' bound the opening although saw cuts through these walls can open to openings 28' for wires or the like.

Figure 5:
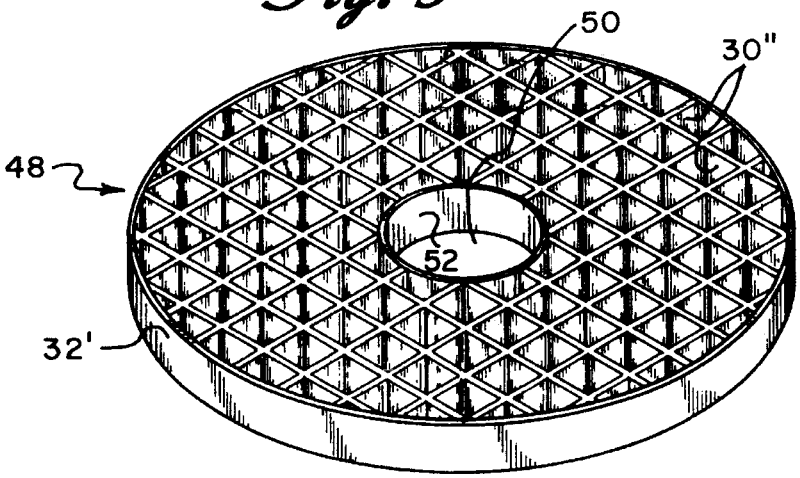
FIG. 5 is a perspective view of a third embodiment of the invention.

In this embodiment, opening 46 adjacent to the edge allow other wires and smaller tubing to be fed down to the workers below through the device at the same time tile larger tubing. Opening 40 may be enlarged on site with a simple wood saw. Device 44 is illustrated in FIG. 5 with center opening 46 being a six inch diameter circular hole bounded by integrally molded band 48. In this embodiment, the diameter of hole 46 is sufficient to receive air blower tubing with minimal sacrifice of structural strength as this hole does not open to the square openings bounded by walls 30". Integral band frame 32' is similar to that of frame 32.

While this invention has been described with reference to specific embodiments disclosed herein, it is not confined to the details set forth and the patent is intended to include modifications and changes which may come within and extend from the following claims.

I claim:

1. A method of protecting a manhole opening through a ground surface, the opening covered by a permanent cover that interfits into the opening and rests on a ledge extending inwardly from an outer edge of the opening, the method comprising:

(a) removing the permanent cover from the manhole opening and setting it to a side, (b) providing a temporary manhole cover comprising an integral body comprising:

(i) a circular disc shape of a size to interfit into the opening, (ii) an outer circular edge having a thickness, (iii) a multiplicity of first openings through a thickness of the disc shape spaced apart across the entire shape, and (iv) second opening through the outer circular edge of the disc shape of the temporary manhole cover, the second opening having a width in a range of about four inches to about eight inches, wherein the thickness of said outer circular edge is sufficient to position a top surface of the body proximate the ground surface, and wherein the body is of a composition of a weight to allow it to be lifted upwardly by a person in the manhole below the temporary manhole cover, and of a strength to support a motor vehicle driving on the top surface of the temporary manhole cover, (c) descending into the manhole, and (d) placing the temporary manhole cover into the manhole resting outer circular edge of the body on the ledge extending inwardly from the outer edge of the manhole opening.

2. The method of claim 1 wherein the providing of the temporary manhole cover further comprises an outer circular frame integral with the body, the frame being of a size and shape to interfit into the opening and rest on the ledge.

3. The method of claim 2 wherein the providing of the temporary manhole cover further comprises providing that the temporary manhole cover is a composition of a composite material.

4. The method of claim 1 wherein the providing of the temporary manhole cover further comprises providing that the body is a composition of a composite material.

5. The method of claim 4 wherein the composite material is glass fiber reinforced polymeric plastic.

6. The method of claim 5 wherein the polymeric plastic is crosslinked.

7. The method of claim 1 wherein the providing of the temporary manhole cover further comprises providing lifting means to allow the temporary manhole cover interfitted into the manhole opening to be lifted upwardly by a single person standing above the manhole opening.

8. The method of claim 7 wherein the lifting means comprises a rope fed through an opening through the body.

9. A manhole cover device for temporarily covering a manhole opening through a road surface, the opening being normally covered by a permanent cover that interfits into the opening and rests on a ledge extending inwardly from an outer edge of the opening, wherein the permanent cover has been temporarily removed, the device comprising an integral unit comprising:

(a) a circular disc shape of a size to interfit into the opening, (b) an outer circular edge having a thickness, (c) a multiplicity of openings through a thickness of the disc shape spaced apart across the entire shape, and (d) a second opening through the thickness of the disc shape, the second opening having a width of at least about four inches and opens through the outer circular edge of the disc, wherein the thickness of outer circular edge is sufficient to position a top surface of the disc proximate the ground surface, and wherein the integral unit is of a composition of a weight to allow it to be lifted upwardly by a person in the manhole below the temporary manhole cover, and of a strength to support a motor vehicle driving on the top surface of the temporary manhole cover.

10. The device of claim 4 wherein the composition is a composite material.

11. The device of claim 10 wherein the composite material is glass fiber reinforced polymeric plastic.

12. The device of claim 11 wherein the polymeric plastic is crosslinked.

13. The device of claim 9 further comprising lifting means to allow the device interfitted into the manhole opening to be lifted upwardly by a single person standing above the manhole opening.

14. The device of claim 13 wherein the lifting means comprises a rope fed through an opening through the body.

15. The device of claim 9 wherein the second opening is bounded by a frame.

* * * * *